United States Patent [19]

Erdmannsdörfer et al.

[11] 4,436,535

[45] Mar. 13, 1984

[54] METHOD AND DEVICE FOR REMOVING SOOT FROM EXHAUST GASES

[75] Inventors: Hans Erdmannsdörfer, Ludwigsburg; Manfred Wagner, Stuttgart; Gerd Weyh, Leonberg-Eltingen, all of Fed. Rep. of Germany

[73] Assignee: Filterwerk Mann & Hummel GmbH, Ludwigsburg, Fed. Rep. of Germany

[21] Appl. No.: 360,650

[22] Filed: Mar. 22, 1982

[30] Foreign Application Priority Data

Mar. 21, 1981 [DE] Fed. Rep. of Germany ..... 3111228

[51] Int. Cl.³ ..... B01D 46/04

[52] U.S. Cl. ..... 55/96; 55/272; 55/283; 55/466; 55/DIG. 30; 60/274; 60/311; 60/295; 422/111; 422/178

[58] Field of Search ..... 55/262, 210, 213, 217, 55/96, 466, 283, 523, 527, 272, 97, DIG. 30; 422/168, 178, 111, 110, 112; 60/311, 274, 295; 423/213.2, 437; 110/203

[56] References Cited

U.S. PATENT DOCUMENTS

| | | | |
|---|---|---|---|
| 1,716,481 | 6/1929 | Bilksky | 60/295 |
| 3,800,532 | 4/1974 | Schiskow | 60/295 |
| 3,937,015 | 2/1976 | Akado et al. | 60/311 |
| 4,217,757 | 8/1980 | Crone | 60/311 |
| 4,281,512 | 8/1981 | Mills | 55/213 |
| 4,303,552 | 12/1981 | Ernest et al. | 423/213.2 |
| 4,324,572 | 4/1982 | Erdsmandorfer | 55/257 |
| 4,335,574 | 6/1982 | Sato et al. | 55/212 |
| 4,359,863 | 11/1982 | Virk et al. | 55/269 |

FOREIGN PATENT DOCUMENTS

| | | | |
|---|---|---|---|
| 2756570 | 9/1978 | Fed. Rep. of Germany . | |
| 2815365 | 1/1979 | Fed. Rep. of Germany . | |
| 2750960 | 5/1979 | Fed. Rep. of Germany . | |
| 2930969 | 2/1981 | Fed. Rep. of Germany | 60/311 |

*Primary Examiner*—Bernard Nozick
*Attorney, Agent, or Firm*—Joseph A. Geiger

[57] ABSTRACT

A method and device for removing soot from the exhaust gases of a diesel-type internal combustion engine, using a soot filter in the exhaust line and a dosing device which injects a dose of a combustion-inducing substance, for example CuCl, into the soot filter by means of compressed air. The soot-combusting process is initiated automatically, in response to a critical exhaust pressure level and the simultaneous presence of a suitable temperature in the soot filter, using a pressure switch and a series-connected thermal switch. Compressed air, flowing through a bypass line, scavenges the supply line of the combustion-inducing substance, while supplying additional oxygen for the soot combustion process.

15 Claims, 2 Drawing Figures

METHOD AND DEVICE FOR REMOVING SOOT FROM EXHAUST GASES

BACKGROUND OF THE INVENTION

1. Field of the Invention

The present invention relates to ways and means for eliminating particulate pollutants from combustion gases and, more particularly, to a method and device for removing soot from exhaust gases of internal combustion engines, especially diesel engines, wherein the particles are filtered from the exhaust gas flow and combusted with the aid of a combustion-inducing substance.

2. Description of the Prior Art

The exhaust gases of certain internal combustion engines, especially of the compression-ignited diesel-type, contain unburned carbon particles in the form of soot which, when allowed to discharge into the atmosphere, represent an air pollutant.

In an effort to remove this air pollutant, it has already been suggested to arrange in the exhaust system of the internal combustion engine a soot filter with a filter cartridge of highly temperature-resistant material which collects and retains the soot. However, as more and more soot accumulates on the surface of the filter cartridge during operation of the engine, the flow resistance of the filter cartridge increases to a point where the exhaust flow is substantially blocked, or small chunks of soot are torn through the filter cartridge to create flow channels, thereby defeating and destroying the soot filter.

The need for the periodic removal of the accumulated soot from the exhaust filter has already led to the suggestion of combusting the soot layer on the filter cartridge. This very attractive method of soot removal, however, requires not only the presence of oxygen for combustion, but also temperature levels which are not regularly present, at least not under idling or partial-load operating conditions of the internal combustion engine. It then becomes necessary to provide a supplemental heat source to obtain the necessary combustion temperature.

Such a supplemental heat source is suggested in the German Offenlegungsschrift (Publ. Application) No. 27 56 570 (corr. to U.S. Appln. Ser. No. 779,372 of Mar. 21, 1977) which discloses a heatable exhaust filter for a fuel-injected internal combustion engine. A filter bed of clay-covered steel wool collects the carbon particles from the exhaust gas, and an electrical heater upstream of the filter bed supplies supplemental heat for the combustion of the accumulated soot. This device requires a comparatively large amount of electrical energy for its heater, because the heat is not imparted to the carbon particles directly, but to the exhaust gases which transmit only a portion of the heat to the soot on the filter bed, while carrying a large portion of the heat to the exhaust outlet.

In the German Offenlegungsschrift No. 28 15 365 (corr. to U.S. Appln. Ser. No. 811,666 of June 30, 1977) is disclosed another suggestion of an exhaust filter with an auxiliary heat source, the latter being in the form of a burner which is periodically supplied with compressed propane gas and air. As in the previously mentioned example, the supplemental heat is carried to the accumulated soot by the exhaust gas, so that a comparatively large amount of supplemental energy is needed to combust the soot. The filter itself has to be of very highly heat-resistant materials to withstand the localized high temperatures which result from such an arrangement. A separate tank for the heating gas and a source of supply for the latter are necessary.

Another soot filter for fuel-injected internal combustion engines is suggested in the German Offenlegungsschrift No. 27 50 960. In order to utilize the highest possible exhaust temperature, this filter is arranged immediately downstream of the exhaust manifold. It has a filter element of ceramic fibers, intended to produce the effect of a heat sink, in order to achieve the soot combustion temperature. It has been found, however, that under a range of load conditions, the temperature levels obtained with this device are insufficient for a reliable soot removal.

SUMMARY OF THE INVENTION

Underlying the present invention is the primary objective of achieving a combustion of the accumulated carbon particles on a soot filter with a minimal input of supplemental energy. This combustion is to take place in a reliable, controlled procedure which is initiated automatically by a predetermined level of soot accumulation.

The present invention proposes to attain this objective by suggesting a novel method of inducing and facilitating the combustion of the accumulated soot with the aid of combustion-inducing substance. By lowering the ignition temperature of the accumulated soot to a temperature level which is regularly attained in the filter from the action of the exhaust gases, it is possible to dispense with the previously required supplemental heat source. The lower soot combustion temperature also has the advantage of reducing the heat stress to which the filter cartridge is subjected.

In a preferred embodiment of the invention, a predetermined dose of a flowable combustion-inducing substance is sprinkled onto the filter cartridge by means of a flow of compressed air which also serves as combustion air. The combustion-inducing substance is preferably copper(I) chloride (CuCl). Other copper-based substances, such as copper salts or copper oxides, including copper itself, also have soot combustion inducing capabilities.

The proposed novel soot removal method is preferably implemented by means of a device which comprises a supply container holding pulverulent copper(I) chloride to which is connected a pressure line feeding compressed air into the container. A dip tube in the supply container feeds CuCl into a supply line and through a dosing valve assembly to the soot filter.

The dosing valve assembly is preferably controlled electronically by means of a pressure switch which closes in response to a predetermined pressure level upstream of the filter cartridge, reflective of a critical accumulation of soot on the filter cartridge. A series-connected thermal switch delays the actuation of the dosage valve assembly by the pressure switch, until a certain minimal combustion temperature, preferably 350° C., is reached in the filter.

Following the injection of a predetermined dose of CuCl into the filter, the compressed air is switched to a bypass line which joins the supply line downstream of the dosing valve assembly. This flow of compressed air provides additional oxygen for the combustion of the accumulated soot, and it also serves to clean out the supply line of any residual CuCl powder that might otherwise gradually build up and obstruct the flow in the supply line.

The amount of CuCl required for the effective removal of soot from the exhaust gases of an internal combustion engine varies with the pattern of engine operation and is obviously also dependent upon the fuel injection adjustments. Normally, the dosage is preferably held between 0.5 and 2.5 $cm^3$ of pulverulent CuCl for each 70 KW of engine power output. The actual dosage also depends on the choice of the pressure level at which the soot combustion process is to be initiated, i.e. the permissable level of soot accumulation in the exhaust filter.

The proposed soot removal method and soot removal device have the advantages of simplicity and low cost, the dosing valve device being compact and therefore particularly suited for use with vehicular internal combustion engines. The dosing valve assembly and the supply container for the soot remover need not be in the vicinity of the exhaust filter.

Lastly, the present invention suggests that the supply line between the dosing valve assembly and the exhaust filter be arranged with a continuous slope, to prevent the accumulation of condensate in the supply line which might combine with the pulverulent soot removing substance to block the line, or which might dilute a liquid soot removing substance.

By connecting the compressed air to the supply container for the soot remover, the invention takes advantage of the air pressure for the conveyence of the soot remover and for a more accurate dosing, as compared to a dosing device which uses gravity feed, for example.

BRIEF DESCRIPTION OF THE DRAWING

Further special features and advantages of the invention will become apparent from the description following below, when taken together with the accompanying drawing which illustrates, by way of example, a preferred embodiment of the invention which is represented in the various figures as follows.

DESCRIPTION OF THE PREFERRED EMBODIMENT

Figure 1:
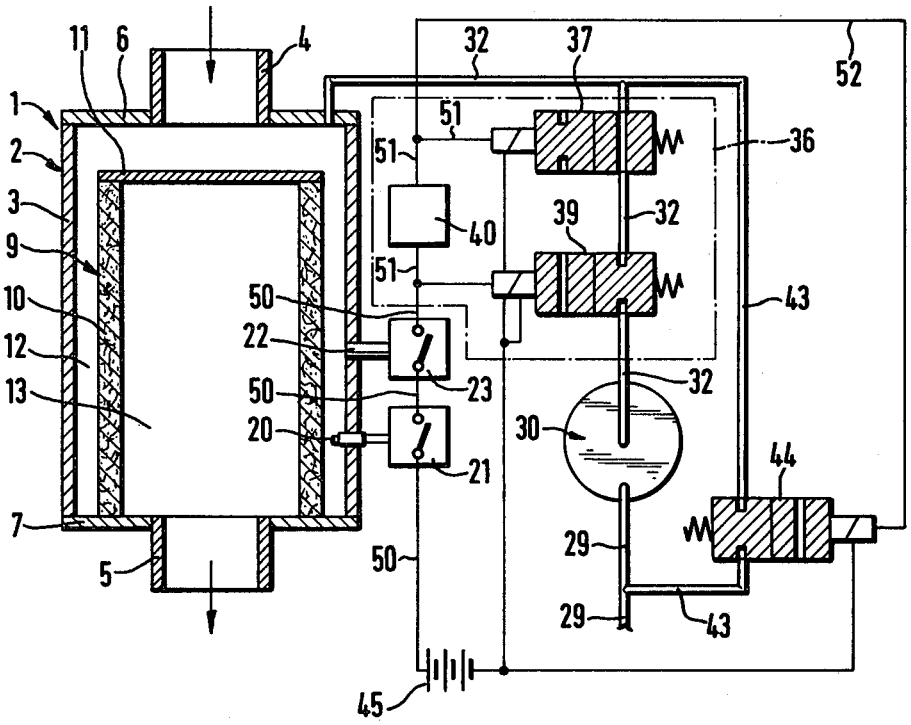
FIG. 1 shows, in a somewhat schematic representation, a soot removing device representing an embodiment of the present invention.

Referring to the drawing, FIG. 1 shows, in a longitudinal cross section, a soot filter 1, as it would be arranged in a horizontal portion of the exhaust line of an internal combustion engine. The soot filter 1 has a filter housing 2 which consists of a cylindrical housing shell 3 with axially oppositely arranged inlet and outlet connectors 4 and 5 which are arranged in flat housing end covers 6 and 7, respectively.

The filter housing 2 encloses a filter cartridge 9 in the form of a filter cylinder 10 which is arranged concentrically inside the housing shell 3, having one axial end face sealingly attached to the end cover 7, on the outlet side of the soot filter 1, and its other axial end closed off by means of a cartridge end cover 11. The wall of the filter cylinder 10 is constituted of silicon dioxide (silica) fibers which serve as a soot-retaining filter structure which is also highly heat resistant. The filter cartridge 9 divides the interior space of the filter housing 2 into a raw gas chamber 12 upstream of the filter cylinder 10 and a clean gas chamber 13 downstream thereof.

In the wall of the housing shell 3 is arranged a temperature probe 20 to which is connected a thermal switch 21. The probe 20 monitors the temperature in the raw gas chamber 12 of the soot filter 1, closing the thermal switch 21, when the temperature is at or above a predetermined limit level. Also arranged in the wall of the housing shell 3 is a connecting pipe 22 which leads to a pressure switch 23. The latter is normally open, but closes, when a predetermined pressure level is reached or exceeded in the raw gas chamber 12.

Figure 2:
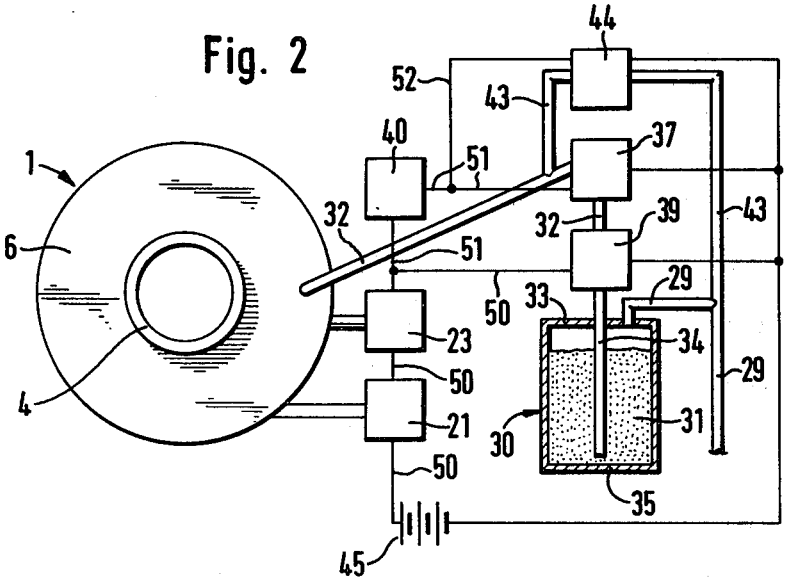
FIG. 2 shows the soot removing device of FIG. 1 in a frontal elevation with partially rearranged control components.

The device of FIG. 1 also includes a source of compressed air (not shown) with a pressure line 29 leading to a container 30 which holds a supply of a combustion-inducing substance 31 (FIG. 2). This substance is preferably pulverulent copper(I) chloride (CuCl). Leading out of the supply container 30 is a supply line 32 which extends through the container cover 33, forming a vertical dip tube 34 with an inlet opening near the container bottom 35. The other end of the supply line 32 is connected to the upstream end cover 6 of the filter housing 2, opening into the raw gas chamber 12. The flow in the supply line 32 is controlled by means of a dosing valve assembly 36 which consists essentially of two series-connected dosing valves 37 and 39 of the spring-returned solenoid-operated type, and an electrical timing relay 40.

A bypass line 43 branches off the pressure line 29 and leads into the supply line 32, downstream of the dosing valve assembly 36, so as to provide a direct connection between the supply of compressed air and the raw gas chamber 12 of the soot filter 1. A shutoff valve 44 controls the flow in the bypass line 43. This valve is likewise of the spring-return solenoid-operated type, operating in conjunction with the dosing valves 37 and 39, as will be explained further below.

In operation, the exhaust gases of an internal combustion engine (not shown) flow through the soot filter 1 in the direction of the arrows shown in FIG. 1. As the gases flow radially inwardly through the filter cartridge 9, the fibers of the latter capture and retain any carbon particles which may have been produced by an incomplete combustion of the fuel in the internal combustion engine. By thus forming a growing layer of soot on its upstream side, the filter cylinder 10 represents a gradually increasing flow resistance to the exhaust gases. It follows that the gas pressure in the raw gas chamber 12 increases accordingly until, at a predetermined critical pressure level, the pressure switch 23 responds by closing.

The closing of the pressure switch 23, by itself, does not automatically initiate a soot combustion operation. For the latter to take place, it is also necessary to have a predetermined minimal temperature level present in the soot filter 1. Thus, the thermal switch 21 may be set for a trigger temperature of 350° C., for example. This trigger temperature is low enough that it is attained routinely, under normal engine operating conditions.

With the pressure switch 23 closed, due to a critical accumulation of soot on the filter cylinder 10, the actuation of the thermal switch 21 by the presence of the trigger temperature in the soot filter 21 closes a valve actuation circuit over the electrical line 50 and the battery 45. As a result, the first dosing valve 39 is switched from its normally closed position to an open position. As the second dosing valve 37 is normally open, the opening of the first dosing valve 39 opens the supply line 32 between the container 30 and the soot filter 1.

The presence of air pressure inside the container 30 produces a flow of soot-combusting substance 31 through the open supply line 32 into the raw gas chamber 12 of the filter housing 2. As the combustion-inducing CuCl powder enters the raw gas chamber 12, it is sprinkled over the surface of the soot layer on the filter cylinder 10 through the action of the exhaust gas flow. By combining with the soot layer, the CuCl lowers the ignition temperature of the soot, so that the latter is combusted and transformed into carbon dioxide gas which passes through the filter cylinder 10.

The opening of the first dosing valve 39 also triggers a timing relay 40, so that, following the lapse of a predetermined time interval, the circuit of the second dosing valve 37 is closed over the electrical line 51, thereby closing the dosing valve 37 and interrupting the flow of combustion-inducing CuCl. The time interval set on the timing relay 40 thus determines the amount of CuCl which is dosed into the soot filter 1. At the end of the dosing operation, both dosing valves are in their actuated state, with compressed return springs, the first dosing valve 39 being open, and the second dosing valve 37 being closed.

Simultaneously with the closing of the second dosing valve 37, the timing relay 40 also closes a solenoid circuit over the electrical line 52, energizing the solenoid of the bypass shutoff valve 44. The latter moves from its normally closed position to an open position, thereby allowing compressed air to flow from the pressure line 29 into the supply line 32, just downstream of the closed second dosing valve 37. This flow of compressed air through the supply line 32, while scavenging the latter, provides additional oxygen for the combustion of the soot layer on the filter cylinder 10. The arrangement of the supply line 32 downstream of the second dosing valve 37 with a continuous slope towards the soot filter 1, as indicated schematically in FIG. 2, prevents the accumulation of condensate in the supply line 32.

As the soot layer on the filter cartridge 9 burns off, the flow resistance across the wall of the filter cylinder 10 is rapidly reduced to a level at which the pressure switch 23 is deactivated and the line 50 is opened. The result is an interruption of the solenoid-energizing circuits and a spring-induced return of the three valves 37, 39 and 44 to their rest positions in which the supply line 32 and the bypass line 43 are both shut off.

Copper(I) chloride has been found to be a preferred soot removing substance for use with the present invention. It is inexpensive and readily available commercially. It should be understood, however, that other substances may be used in conjunction with the method and device of this invention. Thus, it is possible to use as combustion-inducing substances a variety of other materials, especially substances including copper, copper salts, or copper oxides.

The hygroscopic nature of copper(I) chloride may make it necessary, under certain circumstances, to dehumidify the compressed air by arranging an appropriate drying means in the pressure line 29, just ahead of the container 30.

The operation of the dosing valve assembly 36 with electrical switches and solenoid valves which are driven by the vehicle battery is simple and reliable, requiring only a minimum of supplemental energy for the soot removal process. However, instead of using electricity as the auxiliary energy, it is also possible to use compressed air, which then serves not only as a conveying medium for the soot combusting substance, but also as a valve-actuating medium. In this case, the timing relay could be replaced by a simple throttle device. Alternatively, it is also possible to use hydraulic pressure for the operation of the dosing valve assembly.

It should be understood, of course, that the foregoing disclosure describes only a preferred embodiment of the invention and that it is intended to cover all changes and modifications of this example of the invention which fall within the scope of the appended claims.

We claim the following:

1. A method of removing soot from the exhaust gases of an internal combustion engine, particularly of a diesel engine, comprising the steps of:

filtering the soot particles from the exhaust gas by means of an exhaust filter which retains and collects the soot;

during operation of the engine, from time to time burning off the collected soot to a gas which passes through the exhaust filter by adding to the soot a dose of a flowable combustion-inducing substance which lowers the soot ignition temperature and a supply of combustion air;

monitoring the temperature inside the exhaust filter and using the presence of an operating temperature above a predetermined level as a precondition for the initiation of the burn-off step; and monitoring the accumulation of soot in the exhaust filter, in terms of the resultant increase in the flow resistance of the filter, and using the presence of a predetermined flow resistance as a trigger condition for the initiation of the burn-off step.

2. A soot-removing method as defined in claim 1, wherein the step of burning off the soot involves the use of a combustion-inducing substance selected from the group consisting of copper, copper salts and copper oxides.

3. A soot-removing method as defined in claim 1, wherein the step of burning off the soot involves the use of copper(I) chloride as a combustion-inducing substance; and the step of monitoring the exhaust filter temperature uses as said precondition a temperature level of 350° Celsius.

4. A soot-removing method as defined in claim 3, wherein the step of burning off the soot involves the introduction into the exhaust filter of a dose of between 0.5 to 2.5 $cm^3$ of copper(I) chloride per 70 KW of engine output.

5. A soot-removing method as defined in any one of claims 1 through 4, wherein the step of burning off the soot includes the steps of blowing compressed air into the exhaust filter, on its upstream side, thereby providing said supply of combustion air; and metering the dose of combustion-inducing substance into the flow of compressed air, before the latter enters the exhaust filter.

6. A soot-removing method as defined in claim 5, wherein the steps of blowing and metering involve the use of an air supply line into which the combustion-inducing substance is metered by a dosage valve; and the method further includes the step of scavenging the air supply line downstream of the dosage valve with compressed air, after termination of the metering step.

7. A device for removing soot from the exhaust gases of an internal combustion engine, particularly of a diesel engine, comprising in combination;

an exhaust filter, including a housing, an exhaust gas inlet, an exhaust gas outlet, and a gas-permeable heat-resistant filter body subdividing the interior of the housing into a raw gas chamber upstream of the filter body and a clean gas chamber downstream thereof, the filter body being adapted to filter soot particles from the passing exhaust gas and to collect the retained soot particles; and means for feeding into the exhaust filter and sprinkling onto the collected soot a dose of combustion-inducing substance which lowers the soot ignition temperature, said feeding means including:

a source of compressed air and air conduit means leading from said source into the exhaust filter, upstream of the filter body;

valve means in the air conduit means for enabling, from time to time, a flow of compressed air to enter the exhaust filter, the flow of compressed air thereby serving to convey said substance into the exhaust filter and to sprinkle it onto the collected soot, while also supplying oxygen for the combustion of the latter; and dosing means for metering into said flow of compressed air a predetermined quantity of the combustion-inducing substance, as required to burn off the collected soot to a gas which passes through the filter body.

8. A soot-removing device as defined in claim 7, wherein the combustion-inducing substance is a substance selected from the group consisting of copper, copper salts and copper oxides.

9. A soot-removing device as defined in claim 7, wherein the combustion-inducing substance is copper(I) chloride.

10. A soot-removing device as defined in claim 7, further comprising pressure switch means for sensing the pressure upstream of the filter body and for controlling the valve means and dosing means to supply a flow of compressed air and a dose of combustion-inducing substance, respectively, to the exhaust filter, in response to a predetermined accumulation of soot in the exhaust filter which, by causing an increase in the flow resistance across the filter body, reflects itself in a correspondingly higher gas pressure upstream thereof.

11. A soot-removing device as defined in claim 10, further comprising thermal switching means connected to the exhaust filter and operable to inhibit the operation of the dosing means for as long as the temperature inside the filter housing is below a predetermined level.

12. A soot-removing device as defined in claim 11, wherein the combustion inducing substance is copper(I) chloride; and the predetermined temperature level for the thermal switching means is 350° Celsius.

13. A soot-removing device as defined in any one of claims 7 through 12, wherein said substance feeding means further includes a closed container holding the substance;

the air conduit means includes a pressure line leading form the source of compressed air into the container and a supply line leading from a place near the bottom of the container to the exhaust filter;

the dosing means includes dosage valve means in the supply line operable to open and close the supply line in a timed sequence, with the result that a metered quantity of said substance is forcibly conveyed by compressed air from the container to the exhaust filter; and the air conduit means further includes a bypass line leading from the source of compressed air to a junction with the supply line, downstream of the dosage valve means, and a bypass valve in the bypass line which, when opened following closing of the supply line by the dosage valve means, allows compressed air to flow directly into the exhaust filter to supply oxygen for the soot-combustion, while scavenging the supply line downstream of its junction with the bypass line of any residue of said substance.

14. A soot-removing device as defined in claim 13, wherein the supply line includes a dip tube which reaches downwardly into the container to a point near its bottom;

the dosage valve means includes a first, normally closed solenoid valve in the supply line, valve switching means opening said valve in response to predetermined conditions in the exhaust filter, a second normally open solenoid valve in the supply line downstream of the first valve, and valve timing means for closing the second valve a predetermined time after the first valve has been opened;

the bypass valve is a normally closed solenoid valve which is controlled by said valve timing means to open simultaneous with the closing of said second valve, and which is controlled by said valve switching means to close simultaneously with the closing of said first valve, in response to the disappearance of said exhaust filter conditions.

15. A soot-removing device as defined in claim 13, wherein the supply line downstream of the dosage valve means has a continuous downward slope in the direction of the exhaust filter, so as to avoid the retention of any liquid therein.

* * * * *